US007276860B2

(12) United States Patent
Choi et al.

(10) Patent No.: US 7,276,860 B2
(45) Date of Patent: Oct. 2, 2007

(54) ELECTRODELESS LIGHTING SYSTEM

(75) Inventors: Joon-Sik Choi, Seoul (KR); Yong-Seog Jeon, Gyeonggi-Do (KR); Byeong-Ju Park, Seoul (KR); Hyun-Jung Kim, Seoul (KR); Ji-Young Lee, Gyeonggi-Do (KR); Yun-Chul Jung, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 359 days.

(21) Appl. No.: 10/950,463

(22) Filed: Sep. 28, 2004

(65) Prior Publication Data

US 2005/0128750 A1 Jun. 16, 2005

(30) Foreign Application Priority Data

Dec. 13, 2003 (KR) ..... 10-2003-0090972

(51) Int. Cl.
*H05B 41/16* (2006.01)

(52) U.S. Cl. ..... 315/248; 315/39

(58) Field of Classification Search ..... 315/39.51, 315/39.71, 244, 248, 112, 118; 362/263, 362/296, 297

See application file for complete search history.

(56) References Cited

U.S. PATENT DOCUMENTS

| | | | | |
|---|---|---|---|---|
| 5,525,865 | A | 6/1996 | Simpson | 315/39 |
| 6,720,733 | B2 * | 4/2004 | Suzuki et al. | 315/39.51 |
| 6,724,146 | B2 * | 4/2004 | Small | 315/39.77 |
| 6,734,638 | B2 * | 5/2004 | Kang et al. | 315/248 |
| 6,774,581 | B2 | 8/2004 | Choi et al. | 315/248 |
| 6,876,152 | B2 * | 4/2005 | Jeon et al. | 315/39.51 |
| 2002/0135322 | A1 * | 9/2002 | Hochi et al. | 315/248 |
| 2003/0042857 | A1 * | 3/2003 | Suzuki et al. | 315/248 |
| 2003/0057842 | A1 | 3/2003 | Kim et al. | 315/39 |

FOREIGN PATENT DOCUMENTS

| | | |
|---|---|---|
| CN | 1411028 | 4/2003 |
| CN | 1450591 | 10/2003 |
| EP | 1353360 | 10/2003 |
| EP | 1564788 | 8/2005 |
| JP | 9-509780 | 9/1997 |
| JP | 10-189270 | 7/1998 |
| JP | 2001-266803 | 9/2001 |
| JP | 2002-203523 | 7/2002 |
| JP | 2003-22785 | 1/2003 |
| KR | 2002-54162 | 7/2002 |

OTHER PUBLICATIONS

English language Abstract of JP 2002-203523, Jul. 19, 2002.

(Continued)

*Primary Examiner*—Trinh Dinh
*Assistant Examiner*—Tung X Le
(74) *Attorney, Agent, or Firm*—Greenblum & Bernstein, P.L.C.

(57) ABSTRACT

An electrodeless lighting system includes: a resonator which is installed at an exit of a wave guide for guiding microwave generated from a magnetron and making light pass and microwave resonate therein; a bulb positioned in the resonator and having a luminous portion filled with a luminous material emitting light by the microwave energy and a shaft portion integrally extended from the luminous portion; a resonance control member disposed inside the resonator and having a height controlled according to a position of the luminous portion of the bulb and the entire length of the resonator so as to make optimum resonance of the microwave; and a reflector positioned around the resonator for reflecting light emitted from the bulb. Accordingly, the electrodeless lighting system can facilitate light distribution for achieving lateral lighting and a wider range of lighting and simultaneously improve lighting efficiency.

20 Claims, 4 Drawing Sheets

OTHER PUBLICATIONS

English language Abstract of KOREA 2002-54162, Jul. 6, 2002.
U.S. Appl. No. 10/950,466 to Lee et al., filed Sep. 28, 2004.
English language Abstract of JP 9-509780, Sep. 30, 1997.
English language Abstract of JP 10-189270, Jul. 21, 1998.
English language Abstract of JP 2003-22785, Jan. 24, 2003.
English language Abstract of JP 2001-266803, Sep. 28, 2001.

* cited by examiner

ELECTRODELESS LIGHTING SYSTEM

BACKGROUND OF THE INVENTION

1. Field of the Invention

The present invention relates to an electrodeless lighting system, and more particularly, to an electrodeless lighting system capable of facilitating light distribution for achieving lateral lighting and a wider range of lighting and simultaneously improving lighting efficiency.

2. Description of the Background Art

In general, an electrodeless lighting system using microwaves is a device for emitting visible light and ultraviolet light upon applying microwave energy to an electrodeless plasma bulb. The electrodeless lighting system has a longer life span than that of incandescent lamp or fluorescent lamp which is generally used, and has higher lighting effect FIG. 1 is a sectional view showing a structure of a conventional electrodeless lighting system.

As shown therein, in the conventional lighting lamp system, a high voltage generating unit 2 for raising a common AC voltage to a high voltage is installed at one side in a case 1, and a magnetron 3 for generating microwave by a high voltage supplied from the high voltage generating unit 2 is installed at the other side of the case 1.

And, a wave guide 4 is installed inside of the case 1 and communicates with an output portion 3*a* of the magnetron so that microwave generated by the magnetron 3 passes through the wave guide 4. An exit 4*a* of the wave guide 4 is exposed out of the case 1 through an aperture of the case 1.

In addition, a rotary shaft 5 is rotatably coupled at a shaft hole 4*a* formed at a central portion of the wave guide 4 in a vertical direction. A bulb 7 filled with a material which emits light by microwave energy is installed at an upper end portion of the rotary shaft 5 protruding outwardly through the exit 4*a* of the wave guide 4. A bulb rotating motor 8 having a motor shaft 8 connected to the rotary shaft 5 in the wave guide 4 by a connection pipe 7 is installed at a lower end portion of the rotary shaft 5 outside the wave guide 4 in order to rotate the rotary shaft.

And, a mesh-structured resonator 9 having a predetermined height (H) is coupled to the exit 4*a* of the wave guide 4, which is positioned outside the case 1, encompassing the bulb 6. The resonator 9 blocks leakage of electromagnetic waves introduced through the wave guide 4 and simultaneously passes light emitted from the bulb 6. A reflector 10 is fixed around the resonator 9 to cover the outer side of the resonator 9 in order to reflect light which has passed through the resonator 9 after generated in the bulb 6.

The resonator 9 is designed to use a TE mode (Transverse Electric mode). Because only one basic mode is used, intensity of an electric field is strongest at a central portion of the resonator 9. Accordingly, the bulb 6 is installed at a central portion (h) of the resonator, where the intensity of the electric field is strongest.

In addition, a cooling fan assembly 14 including a fan motor 11, a cooling fan 12 and a fan housing 13 having an outlet 13*a* is installed at a lower side of the case 1 so as to cool the magnetron 3 and the high voltage generating unit 2.

And, an inlet 13*b* through which external air is sucked by rotation of the cooling fan 12 is formed at the fan housing 13. A plurality of discharge openings 1*b* are formed at an edge of an upper surface of the case 1 so that the air sucked through the inlet 13*b* can be discharged outside by way of the high voltage generating unit 2 and the magnetron 3.

Non-described reference numeral 15 in the drawing is a dielectric mirror.

An operation of the conventional electrodeless lighting system constructed as above will now be described.

When power is applied, a high voltage is generated in the high voltage generating unit 2, the generated high voltage is supplied to the magnetron 3, and microwave is generated by the applied high voltage in the magnetron 3.

The generated microwave is radiated into the resonator 9 through the wave guide 4, a material within the bulb 6 is electrically discharged by the radiated microwave to thereby generate light by plasma, and the generated light is thrown to the front by being reflected by the dielectric mirror 14 and the reflector 10.

And, the bulb rotating motor 8 rotates the rotary shaft 5 so that a temperature of the bulb 6, which is raised by the light generated in the bulb 6, does not exceed a predetermined temperature In addition, the fan motor 11 installed at a lower portion inside the case 1 rotates to rotate the cooling fan 12. External air sucked through the inlet 13*b* by the rotation of the cooling fan 12 flows through the outlet 13*a*, cools the high voltage generating unit 2 and the magnetron 3, and then is discharged outside the case 1 through the discharge opening 1*b* formed at the upper surface of the case 1.

However, in the conventional electrodeless lighting system constructed as above, in order to make lateral lighting and wide-area lighting in a basic mode, a distance (h) between a central portion of the bulb 6 and the dielectric mirror 15 is to be designed to be longer. As the distance (h) therebetween becomes long, a height (H) of the resonator should be designed to be longer, and, if the size of the resonator 9 becomes great in such a manner, a higher mode has to be used. If the higher mode is used, a loss of the microwave becomes great in the basic mode, thereby causing not only a size increase of the entire electrode lighting system but also remarkable deterioration in lighting efficiency. Accordingly, the conventional electrodeless lighting system has a problem in that light distribution for achieving lateral lighting and wide-area lighting is difficult.

In addition, if the higher mode is used as described above, a matching characteristic of frequency becomes different from that in a basic mode. Accordingly, a shape of a feeding hole formed at the exit of the wave guide, for outputting microwave into the resonator becomes very complicated, thereby making a design of an electrodeless lighting system for frequency matching complicated.

SUMMARY OF THE INVENTION

Therefore, an object of the present invention is to provide an electrodeless lighting system capable of facilitating light distribution for achieving lateral lighting and a wide range of lighting and simultaneously improving lighting efficiency.

To achieve these and other advantages and in accordance with the purpose of the present invention, as embodied and broadly described herein, there is provided an electrodeless lighting system comprising: a resonator which is installed at an exit of a wave guide for guiding microwave generated in a magnetron and making light pass and microwave resonate therein; a bulb positioned in the resonator and having a luminous portion filled with a luminous material which emits light by the microwave energy and a shaft portion integrally extended from the luminous portion; a resonance control member disposed inside the resonator and having a height controlled according to a position of the luminous portion of the bulb and the entire length of the resonator so as to made optimum resonance of the microwave; and a reflector positioned around the resonator for reflecting light emitted from the bulb.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of an electrodeless lighting system in accordance with the present invention, and, hereinafter, the most preferred embodiment will be described.

Figure 1:
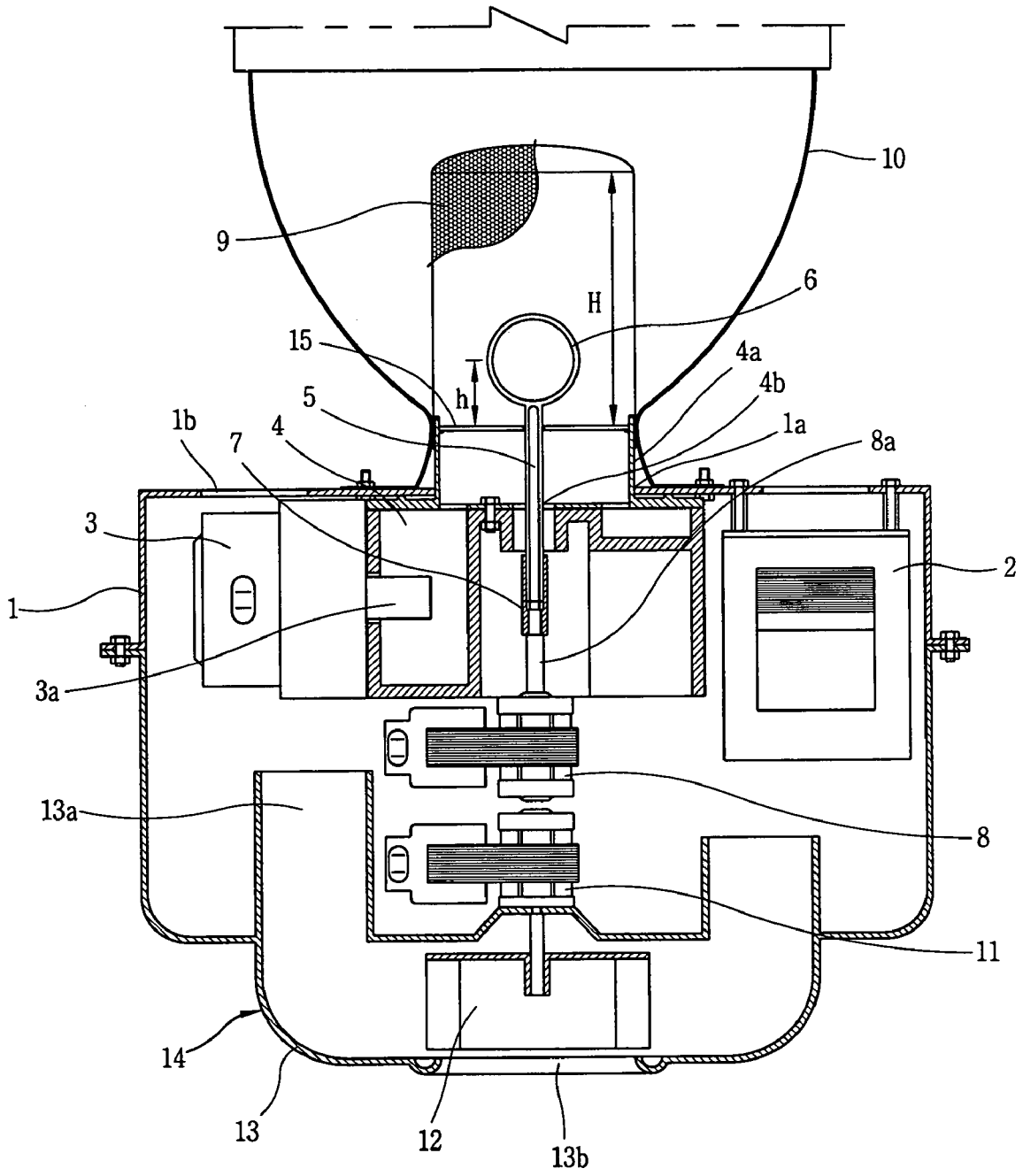
FIG. 1 CONVENTIONAL ART
FIG. 1 is a sectional view showing a conventional lighting lamp system.
Figure 2:
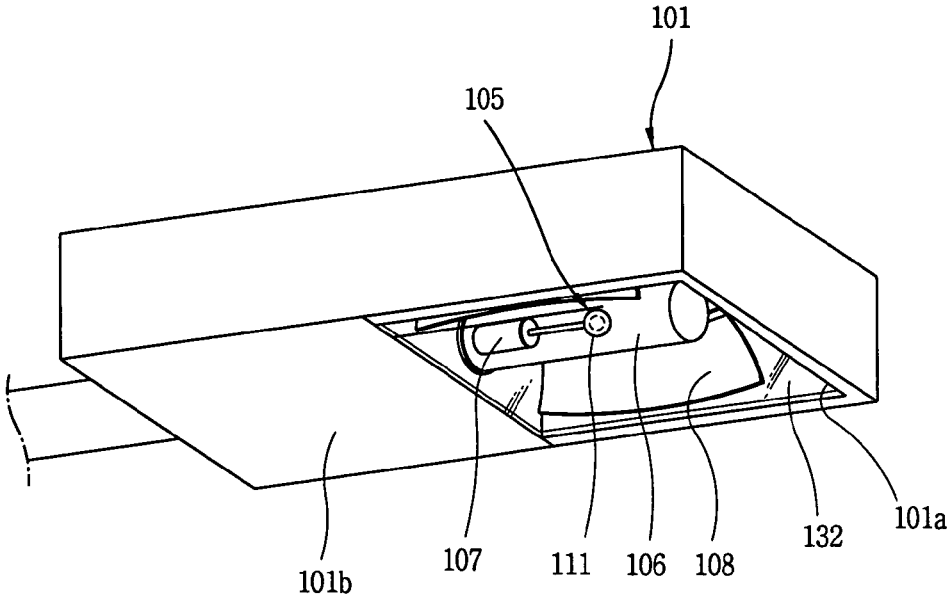
FIG. 2 is a perspective view showing an electrodeless lighting system in accordance with one embodiment of the present invention.
Figure 3:
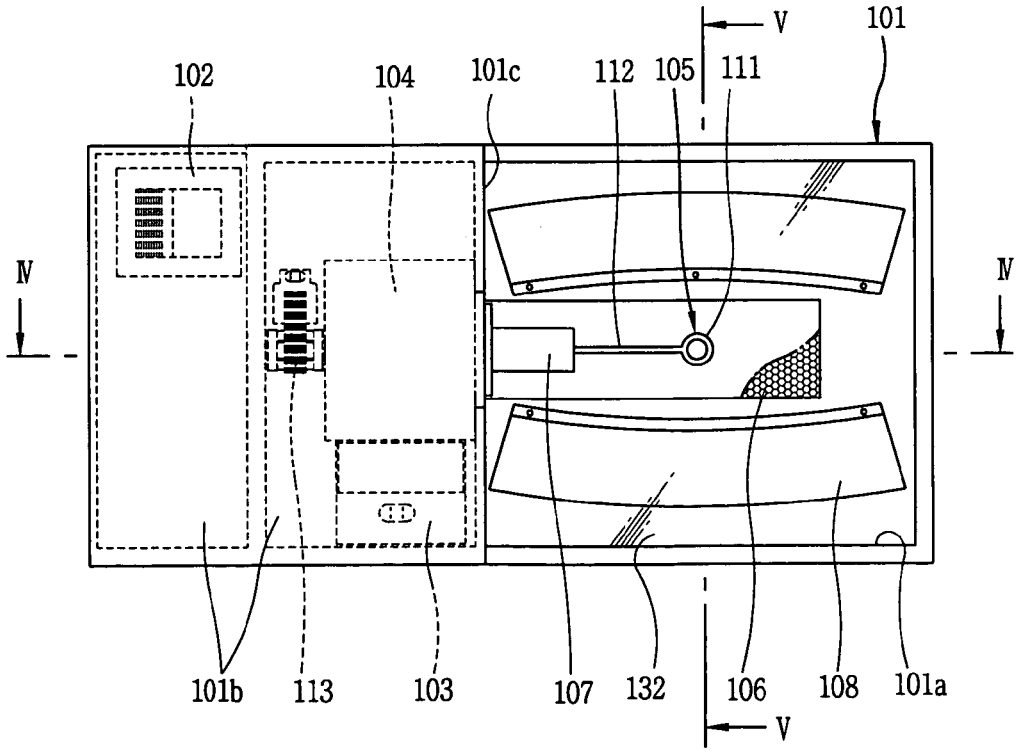
FIG. 3 is a bottom view of FIG. 2.
Figure 4:
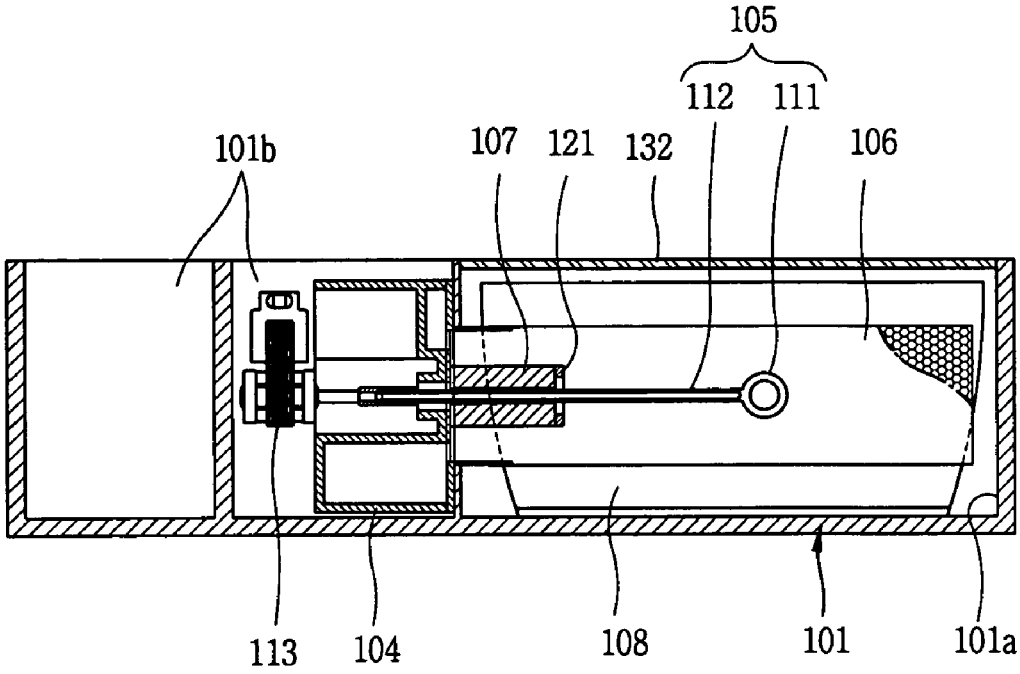
FIG. 4 is a sectional view taken along line IV-IV of FIG. 3.
Figure 5:
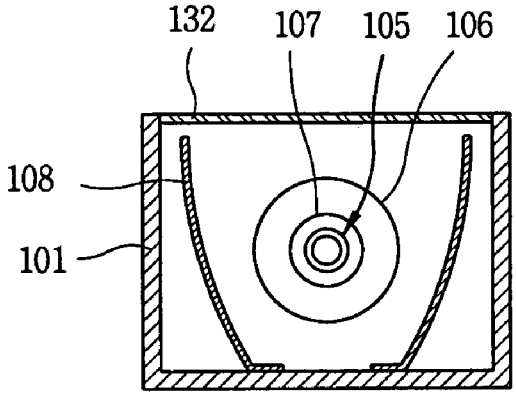
FIG. 5 is a sectional view taken along line V-V of FIG. 3.
Figure 6:
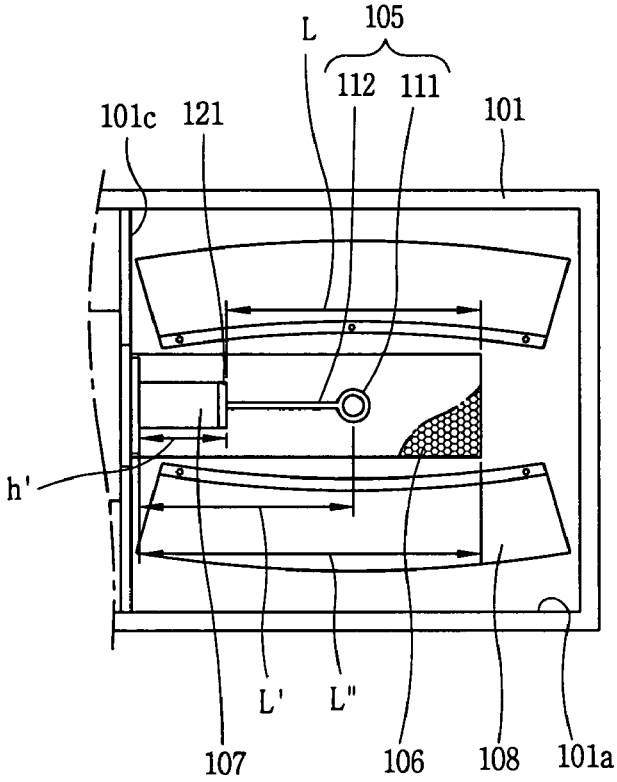
FIG. 6 is a bottom view showing a main part of an electrodeless lamp in accordance with one embodiment of the present invention.

FIG. 2 is a perspective view showing a plasma lamp system in accordance with one embodiment of the present invention, FIG. 3 is a bottom view of FIG. 2, FIG. 4 is a sectional view taken along line IV-IV of FIG. 3, FIG. 5 is a sectional view taken along line V-V of FIG. 3, and FIG. 6 is a bottom view showing a main part of an electrodeless lighting system in accordance with one embodiment of the present invention.

As shown therein, a plasma lamp system in accordance with the present invention includes a case 101, a high voltage generating unit 102, a magnetron 103, a wave guide 104, a bulb 105, a resonator 106, a resonance control member 107 and a reflector 108.

The case 101 includes an opening 101*a* formed as one portion of one surface of the case 101 is opened; and a machine chamber 101*b* formed adjacent to the opening 101*a*, in which the magnetron 103, the high voltage generating unit 102 and the wave guide 104 are positioned.

The high voltage generating unit 102 is fixed at one side in the machine chamber 101*b*, generates a high voltage when a common AC voltage is applied thereto, and supplies the generated high voltage to the magnetron 103.

The magnetron 103 is installed at the other side of the machine chamber 101*b*, and converts electrical energy into high frequency energy such as microwave when a high voltage is inputted from the high voltage generating unit 102. The converted high voltage energy is outputted to the wave guide 104 through an antenna (not shown) insertedly fixed in the wave guide 104 installed at one side of the magnetron 103.

The wave guide 104 guides the microwave outputted from the magnetron 103 into the resonator 106.

The resonator 106 is installed at an exit 104*a* of the wave guide 104 for guiding microwave generated from the magnetron 103 and makes light pass and microwave resonate therein. More detail, the resonator 106 is installed at the opening 101*a* to cover the bulb 106, and one side of the resonator 106 is coupled to an outer circumferential surface of an exit 104*a* of the wave guide 104.

In addition, the resonator 106 has a netlike metallic body and is formed in a cylindrical shape, and a cross-section of the resonator 106 is preferably formed in a circular shape or a polygonal shape.

In addition, in order to reduce the size of the resonator 106, the resonator 106 is preferably filled with a dielectric material.

The bulb 105 includes a spherical luminous portion 111 having a predetermined internal volume and filled with a luminous material which emits light by the microwave energy, and a shaft portion 112 integrally extended from the luminous portion 111.

The luminous portion 111 is disposed inside the resonator 106, and the shaft portion 112 is penetratingly installed to pass through the central portion of the wave guide 104. In addition, the shaft portion 112 is connected to a motor shaft (not shown) of a bulb rotating motor 113 installed in the machine chamber 101*b* of the case 101 to thereby be rotated at a predetermined speed.

The luminous portion 111 is preferably made of a material having high light transmittance and low dielectric loss, such as quartz. A material within the luminous portion 111 is constituted by a luminous material such as metal, halogen compounds, sulfur or selenium for leading light-emission by forming plasma, inert gas such as argon, xenon, kripton for forming plasma inside the bulb 106 at an initial stage of emitting light, and additives for making the lighting to be easy by helping the initial discharge or for controlling spectrum of the emitted light.

The resonance control member 107 is disposed inside the resonator 106 is and has a through hole therein; the shaft portion 112 of the bulb 105 is rotatably installed in the through hole of the resonance control member 107.

Also, a height (h') of the resonance control member 107 is controlled according to the position of the luminous portion 111 of the bulb 105 and the entire length (L") of the resonator 106 so that optimum resonance is generated inside the resonator 106.

Here, it is advisable that the luminous portion 111 of the bulb 105 is centrally located between one outer end of the resonance control member 107 and one inner end of the resonator 106.

That is, as shown in FIG. 6, in the present invention, an interval (L') between one inner wall 101*c* of the opening 101*a* and the luminous portion 111 of the bulb 105 is longer than that of the conventional electrodeless lighting system. As the interval (L') between the one inner wall (101*c*) and the luminous portion 111 of the bulb 105 is longer, the entire length (L") of the resonator 106 is designed to be longer. In such a state, the resonance control member 107 is installed to control a resonant interval (L) between one inner end of the resonance control member and one outer end of the resonator 106, so that resonance of electromagnetic waves is generated in a basic mode.

The resonance control member 107 is made of a metal material, and is formed in a cylindrical shape like the shape of the resonator 106. In addition, its cross section is preferably formed in a circular shape or in a polygonal shape.

Also, a ring-shaped stub 121 for impedance matching is integrally formed at one end of the resonance control member 107.

In addition, dielectric coating or metallic coating is preferably performed on an outside of the resonant control member 107, so that resonant efficiency of microwave in the resonator 106 is improved.

Figure 7:
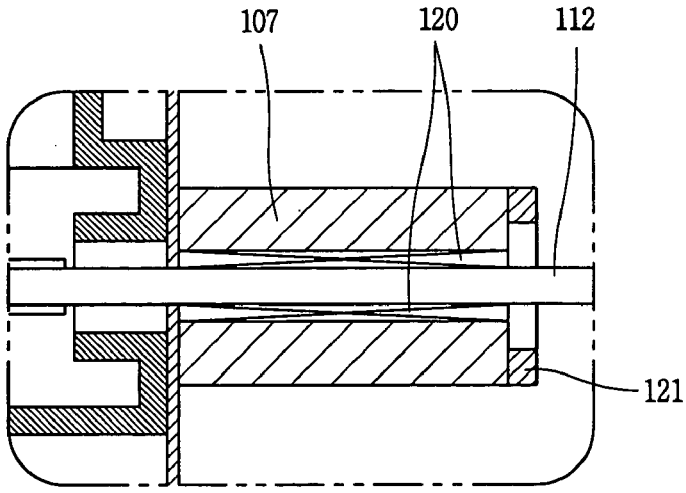
FIG. 7 is an enlarged view showing a resonance control member of FIG. 4.

In addition, as shown in FIG. 7, a bearing 120 for smooth rotation of the shaft portion 112 is mounted at an inner circumferential surface of the through hole of the resonance control member 107, which comes in contact with the shaft portion 112 of the bulb 105.

The reflector 108 is a metallic plate body. A pair of reflectors 108 are installed at the opening 101*a* of the case 101 at a predetermined interval, and reflect light emitted from the luminous portion 111 of the bulb 105 to thereby allow the light to be laterally thrown through the opening 101*a*.

In addition, the reflector 108 preferably has a predetermined radius of curvature in order to efficiently reflect light.

Non-described reference numeral 132 is a lamp cover.

An operation of the electrodeless lighting system in accordance with one embodiment of the present invention constructed as above will now be described.

When a high voltage generated in a high voltage generating unit 102 is inputted to a magnetron 103, microwave having high frequency energy is generated in the magnetron 103, and the generated microwave is outputted through an antenna. The outputted microwave is guided into a resonator 106 by way of a wave guide 104, and an optimum resonant frequency is selected in the resonator 106.

The microwave in the selected resonant frequency band resonates in a resonant space of the resonator 106, forming a strong electric field at a luminous portion 111 of a bulb 105. Inert gas within the luminous portion 111 is electrically discharged by the formed electric field, and heat generated during said electric discharge gasifies a luminous material, forming plasma. The plasma maintains the electric-discharge by the microwave, thereby emitting light of high intensity. The light is reflected by a reflector 108, thereby performing lighting through the opening 101*a*.

An operation of the electrodeless lighting system in accordance with the present invention will now be described in more detail.

As the interval (L') between one inner wall 101*c* of the opening 101*a* of the case 101 and the luminous portion 111 of the bulb 105 is formed long, the entire length (L") of the resonator 106 is designed to be long. In such a state, a resonant interval (L) in the resonator 106 is determined according to a controlled height (h') of the resonance control member 107 so that resonance of the microwave can be generated in a basic mode. Here, the luminous portion 111 of the bulb 105 is positioned at a central portion of the resonant interval (L), where the intensity of an electric field is strongest.

Here, the reflector 108 for reflecting light emitted in the luminous portion 11 is disposed at a rear of the luminous portion 111, thereby achieving lateral lighting and a wider range of lighting.

As so far described, in the electrodeless lighting system in accordance with the present invention, because a resonant interval in a resonator is easily controlled by the resonance control member, a strong electric field can be formed at a luminous portion sufficiently just in a basic mode without microwave loss in the basic mode due to a use of a higher mode even if an interval between an exit of a wave guide, one inner wall of an opening of a case, and the luminous portion of the bulb is lengthened, and thus the size of the resonator becomes great.

Accordingly, the size and the disposition of a reflector can be more freely designed, thereby easily achieving lateral lighting and a wider range of lighting.

Also, efficient lighting can be made when the present electrodeless lighting system is used for a lighting device such as a street lamp which performs lateral lighting.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system, comprising:

a resonator, disposed at an exit of a wave guide that guides a microwave generated by a magnetron, that passes light and in which a microwave resonates;

a bulb disposed in the resonator and having a luminous portion filled with a luminous material which emits light when microwave energy is applied thereto and a shaft portion integrally extending from the luminous portion;

a resonance control member disposed inside the resonator and having its height controlled according to a position of the luminous portion of the bulb and an entire length of the resonator to optimize the resonance of the microwave; and a reflector positioned around the resonator that reflects light emitted from the bulb.

2. The system of claim 1, further comprising a bulb rotating motor connected to the shaft portion of the bulb.

3. The system of claim 2, wherein the resonance control member has a through hole therein and the shaft portion of the bulb is rotatably installed in the through hole.

4. The system of claim 3, wherein a bearing is mounted at an inner circumferential surface of the through hole of the resonance control member, which comes in contact with the shaft portion of the bulb, for smooth rotation of the shaft portion.

5. The system of claim 1, wherein the resonance control member comprises metal.

6. The system of claim 5, wherein a ring-shaped stub that matches impedance is integrally formed at one end of the resonance control member.

7. The system of claim 1, wherein the resonance control member is formed in a cylindrical shape.

8. The system of claim 7, wherein a cross-section of the resonance control member has a circular shape.

9. The system of claim 7, wherein a cross-section of the resonance control member has a polygonal shape.

10. The system of claim 7, wherein one of a dielectric coating and a metallic coating is provided on an outer circumferential surface of the resonance control member.

11. The system of claim 1, wherein the resonator is formed in a cylindrical shape.

12. The system of claim 11, wherein a cross-section of the resonator has a circular shape.

13. The system of claim 11, wherein a cross-section of the resonator has a polygonal shape.

14. The system of claim 11, wherein the resonator is filled with a dielectric material.

15. The system of claim 1, wherein the luminous portion of the bulb is centrally located between one outer end of the resonance control member and one inner end of the resonator.

16. The system of claim 1, wherein the resonance control member enables the electrodeless lighting system to efficiently provide lateral lighting and wide range lighting.

17. An electrodeless lighting system, comprising:

a resonator;

a bulb disposed in the resonator and comprising a luminous portion and a shaft portion extending from the luminous portion; and a resonance control member comprising a through hole, the shaft portion of the bulb being disposed within the through hole of the resonance control member, wherein the bulb is disposed in the resonator such that the luminous portion of the bulb is centrally positioned between a first end of the resonator and a first end of the resonance control member.

18. The electrodeless lighting system of claim 17, further comprising a case in which the resonator is disposed, wherein a second end of the resonator and a second end of the resonance control member abut an inner wall of the case.

19. The electrodeless lighting system of claim 17, further comprising an impedance matching stub formed at the first end of the resonance control member.

20. The electrodeless lighting system of claim 17, wherein one of a dielectric coating and a metallic coating is provided on an outer surface of the resonance control member.

* * * * *